US006311519B1

(12) United States Patent
Gourbier et al.

(10) Patent No.: US 6,311,519 B1
(45) Date of Patent: Nov. 6, 2001

(54) PROCESS AND PLANT FOR SEPARATING A GASEOUS MIXTURE BY CRYOGENIC DISTILLATION

(75) Inventors: Jean-Pierre Gourbier; Lucien Greter, both of Le Plessis Trevise (FR)

(73) Assignee: L'Air Liquide, Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/599,648

(22) Filed: Jun. 23, 2000

(30) Foreign Application Priority Data

Jun. 23, 1999 (FR) ..... 99 08011

(51) Int. Cl.[7] ..... F25J 1/00
(52) U.S. Cl. ..... 62/654; 62/50.6
(58) Field of Search ..... 62/654, 50.6

(56) References Cited

U.S. PATENT DOCUMENTS 2,711,085 6/1955 Anderson .
4,962,646 * 10/1990 Rathbone ..... 62/654
5,348,456 9/1994 Kun et al. .
5,379,599 * 1/1995 Mostello ..... 62/654
5,460,003 10/1995 Nenov .
5,475,980 * 12/1995 Grenier et al. ..... 62/654
5,477,689 * 12/1995 Guillard et al. ..... 62/654
5,498,007 3/1996 Kulkarni et al. .
5,566,556 * 10/1996 Ekins et al. ..... 62/654
5,582,031 * 12/1996 Rathbone ..... 62/654

FOREIGN PATENT DOCUMENTS 49-117364 11/1974 (JP) .

* cited by examiner

*Primary Examiner*—Ronald Capossela
(74) *Attorney, Agent, or Firm*—Young & Thompson

(57) ABSTRACT

A cryogenic distillation apparatus comprising a system of columns (9, 11) also includes at least one external source of a gas other than a column of the system and means for sending this pressurized gas to the first pump (17) in order to serve as barrier gas for a pump (17, 23, 25, 27) and/or at least one external source (20) of liquid other than a column of the system and means for vaporizing at least one portion of this liquid and for sending the vapour thus formed to the first pump in order to serve as barrier gas and/or means (3) for withdrawing a liquid from a column of the system and for vaporizing at least one portion thereof downstream of the first or of the second pump in order to deliver a barrier gas (21) for the first pump.

21 Claims, 4 Drawing Sheets

PROCESS AND PLANT FOR SEPARATING A GASEOUS MIXTURE BY CRYOGENIC DISTILLATION

FIELD OF THE INVENTION

Figure 1:
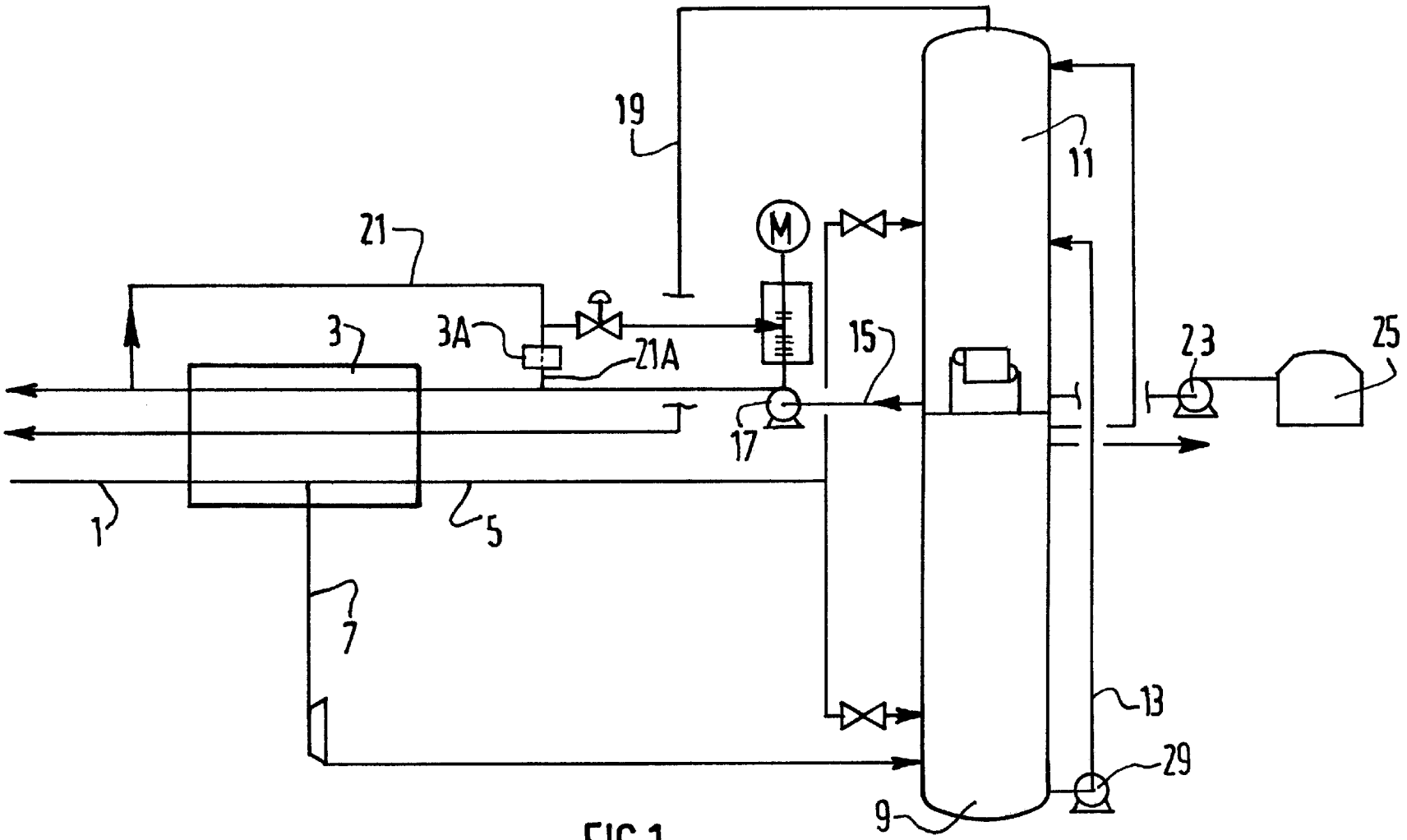

The present invention relates to a process and to a plant for separating a gas mixture, for example air, by cryogenic distillation and in particular to a process for the production of pressurized gas.

BACKGROUND OF THE INVENTION

It is known to pressurize a liquid produced by a distillation column in a pump and to vaporize it in the main exchanger of the apparatus in order to deliver pressurized gas. The gases produced are sometimes contaminated with the barrier gas from the pump. The barrier gas used most frequently is nitrogen since it is available in the separation units and has a low cost price and a suitable pressure (see Epifanova and Axelrod, Séparation de l'air [Air separation], Editions Mashinostroienie 1964, Volume 1, pages 199, 203). If the pumped liquid is oxygen, it may be contaminated by this nitrogen because of the wear of the labyrinth seals of the pump or because of a maladjustment of the control members, or by back-diffusion.

To alleviate this problem, JP 49,117,364 proposes to vaporize a portion of the liquid intended for the pump in an exchanger dedicated to producing the barrier gas.

One aim of the invention is to simplify the plant.

One object of the invention is to provide a process for separating a gas mixture by cryogenic distillation, in which:

- at least one portion of the mixture compressed and purified in an exchanger is cooled;
- the cooled mixture is sent to a distillation column of a system comprising at least one column;
- a liquid is withdrawn from a column of the system;
- the liquid is pressurized in a first pump;
- use is made, as barrier gas for one or more pumps of the system, of:
  - i) a gas coming from an external source other than a column of the system and/or
  - ii) the vapour produced by vaporizing a liquid coming from an external source and/or
  - iii) the vapour produced by vaporizing a portion of a liquid withdrawn from a column of the system and pressurized in the first pump or a second pump.

According to other optional aspects of the invention, provision is made so that:

- a portion of the liquid pressurized in the first pump is vaporized in the exchanger where at least one portion of the gas mixture cools;
- at least one gas produced by the column is heated in the exchanger where at least one portion of the gas mixture cools;
- only the portion of the gas mixture and the liquid which is pressurized in the first pump are sent to the exchanger;
- the liquid vaporized in order to form the barrier gas is pressurized by a second pump, this liquid pressurized in the second pump having the same main component as the liquid pressurized in the first pump and being as pure as or purer than the liquid pressurized in the first pump;
- the gas mixture is air and the liquid pressurized in the first pump is rich in oxygen, nitrogen or argon;

- the gas mixture contains at least 1% methane, at least 1% carbon monoxide, at least 1% hydrogen and/or at least 1% nitrogen and the liquid pressurized in the first pump is rich in methane, carbon monoxide, hydrogen or nitrogen;
- the barrier gas is at a pressure greater than the suction pressure in the first pump;
- the barrier gas is sent to all the pumps of the system which pump a liquid having the same main component as the liquid pumped by the first pump;
- the system includes a pump for sending a liquid from one of the columns to the storage tank and/or a falling-film-evaporator pump and/or a pump for sending liquid from one column of the system to another column of the system and in which the barrier gas for at least one of these pumps is
  - i) a gas coming from an external source other than a column of the system and/or
  - ii) the vapour produced by vaporizing a liquid coming from an external source and/or
  - iii) the vapour produced by vaporizing a portion of a liquid withdrawn from a column of the system and pressurized in the first pump or a second pump.

Another object of the invention is to provide a plant for separating a gas mixture by cryogenic distillation, which comprises:

- a heat exchanger,
- a first pump and possibly a second pump,
- a system of distillation columns, including at least one column,
- means for sending at least one portion of the gas mixture to the heat exchanger and then to a column of the system,
- means for withdrawing a liquid from a column of the system and for sending it to one or more pumps and
  - i) at least one external source of a gas other than a column of the system and means for sending this pressurized gas to the first pump in order to serve as barrier gas and/or
  - ii) at least one external source of liquid other than a column of the system and means for vaporizing at least one portion of this liquid and for sending the vapour thus formed to the first pump in order to serve as barrier gas and/or
  - iii) means for withdrawing a liquid from a column of the system and for vaporizing at least one portion thereof downstream of the first or of the second pump in order to deliver a barrier gas for the first pump.

According to other optional aspects of the invention, the plant includes:

- means for sending the liquid from the first and/or from the second pump to the exchanger and means for withdrawing the vaporized liquid from the exchanger;
- another heat exchanger in which the liquid intended to deliver the barrier gas is vaporized;
- the gas mixture is air and the system of columns comprises a triple column, a double column or a single column, possibly combined with an argon column and/or a mixing column;
- the first pump and possibly the second pump is (are) (a) labyrinth-seal pump(s);
- means for sending the same barrier gas to all the pumps of the system which pressurize a liquid having the same main component as the liquid pressurized by the first pump;

a pump for sending a liquid from a column of the system to the storage tank and/or a falling-film-evaporator pump and/or a pump for sending liquid from a column or a condenser of the system to another column or another condenser of the system;

the means for sending a barrier gas for at least one of the pumps comprises:

i) an external source of a gas other than a column of the system and means for sending this pressurized gas to the first pump in order to serve as barrier gas and/or ii) an external source of liquid other than a column of the system and means for vaporizing at least one portion of this liquid and for sending the vapour thus formed to the first pump in order to serve as barrier gas and/or iii) means for withdrawing a liquid from a column of the system and for vaporizing at least one portion thereof downstream of the first or of the second pump in order to deliver a barrier gas for the first pump.

BRIEF DESCRIPTION OF THE INVENTION

The invention will now be described with reference to FIGS. 1 to 5 which are schematic representations of plants according to the invention.

DETAILED DESCRIPTION OF THE INVENTION

In FIG. 1, a stream of air 1 at 6 bar is sent to the exchanger 3. After partial cooling, it is divided into two. The stream 5 continues its cooling and is liquefied in the exchanger, while the stream 7 is expanded in a Claude turbine and sent to a double column comprising a medium-pressure column 9 and a low-pressure column 11. The liquefied stream 5 is divided between the two columns of the double column or sent to only one of the columns.

An oxygen-enriched stream 13 is withdrawn from the bottom of the medium-pressure column 9 and sent to an intermediate point of the low-pressure column 11. A stream of liquid nitrogen is sent from the medium-pressure column into the top of the low-pressure column.

A stream 15 containing at least 80% oxygen is withdrawn from the bottom of the low-pressure column 11, pressurized to 30 bar in the pump 17 and sent into the exchanger 3 where it vaporizes and warms up to room temperature.

A portion 21 of this stream is sent as barrier gas to the pump 17.

As a variant, the barrier gas may come from a circuit 18 for supplying pressurized gas having the same main component as the stream 15, but being as pure as or purer than this stream. This gas from the supply circuit may serve as barrier gas if its pressure is greater than the suction pressure of the pump 17. Alternatively, the external source may be a liquid storage tank 20 other than a distillation column of the system. The liquid is then vaporized either in the exchanger 3 or in a dedicated exchanger after a possible pressurization step in order to deliver the barrier gas for the pump 17.

The waste nitrogen 19 from the low-pressure column warms up in the exchanger 3.

The same barrier gas is sent to the pump 23 which serves for sending liquid oxygen to the storage tank 25 and to the pump 27 of the falling-film evaporator, which connects the medium-pressure column to the low-pressure column, and to the pump 29 for lifting the rich liquid.

Should the medium-pressure and low-pressure columns be placed side by side, the same barrier gas may also be sent to the pump which transfers the liquid oxygen from the bottom of the low-pressure column to the condenser at the top of the medium-pressure column.

Should the system include a mixing column, the pressurized liquid sent to the top of the mixing column may come from a pump whose barrier gas is common to all the other pumps.

Obviously, it is possible to use several barrier gases, possibly having different purities, rather than a common barrier gas for all the pumps serving to pressurize a liquid having the same main component.

Should a common barrier gas be used, its purity is equal to or greater than that of the purest liquid pressurized by a pump of the system, for which it serves as barrier gas, and its pressure is greater than the suction pressure of the pump which has the highest suction pressure, for which it serves as barrier gas.

In most cases, the pumped liquid will be rich in oxygen but it is also known to pump nitrogen-rich or argon-rich liquids or, in processes for separating mixtures of hydrogen, carbon monoxide and methane, methane-rich liquids.

In certain cases, it is necessary for the barrier gas to have the same main component as the pumped liquid or even, in addition, for it to be at least as pure as this liquid, if not purer.

In other cases, the barrier gas may have a composition very different from the pumped liquid. For example, for certain applications the oxygen above all does not have to contain any nitrogen while the presence of argon is not deleterious; for other applications, the opposite applies.

In these respective cases, an argon-rich or nitrogen-rich gas may serve as barrier gas. Even air may sometimes serve as barrier gas.

Figure 2:
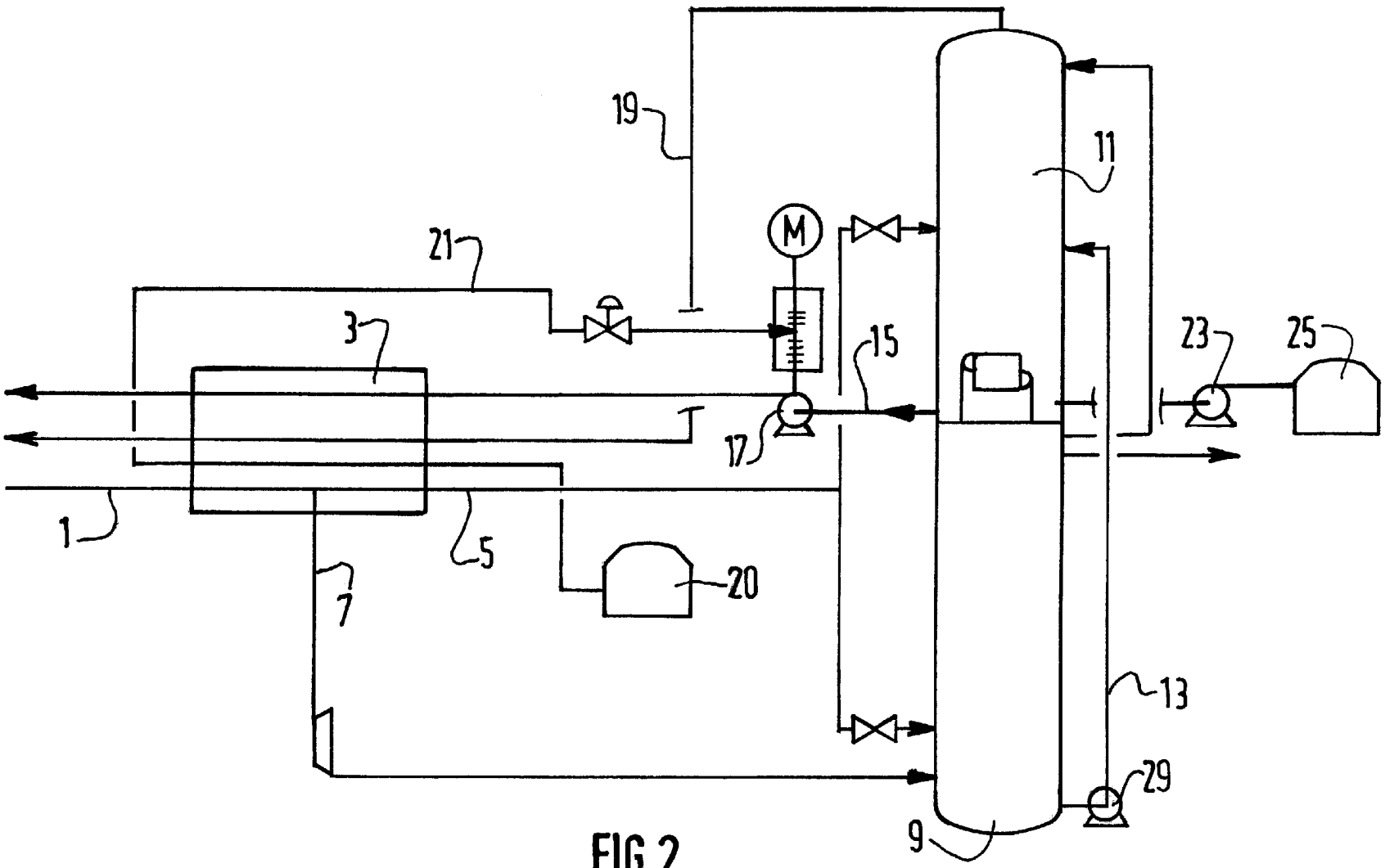

In FIG. 2, an external source of liquid oxygen (therefore an external source other than a column of the system) is connected to means for vaporizing at least one portion of this liquid and means for sending the vapour thus formed to the first pump in order to serve as barrier gas.

Figure 3:
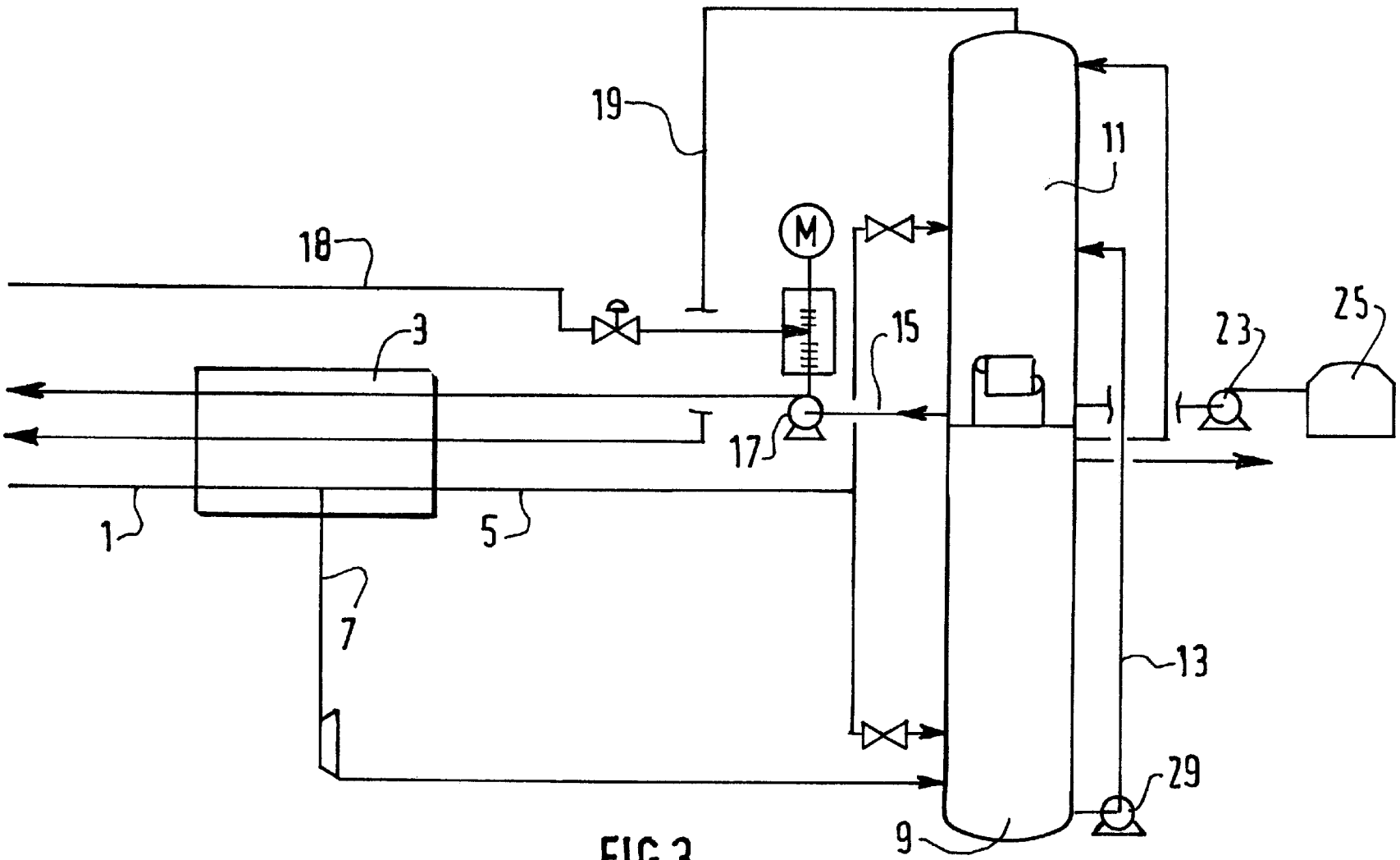
Figure 4:
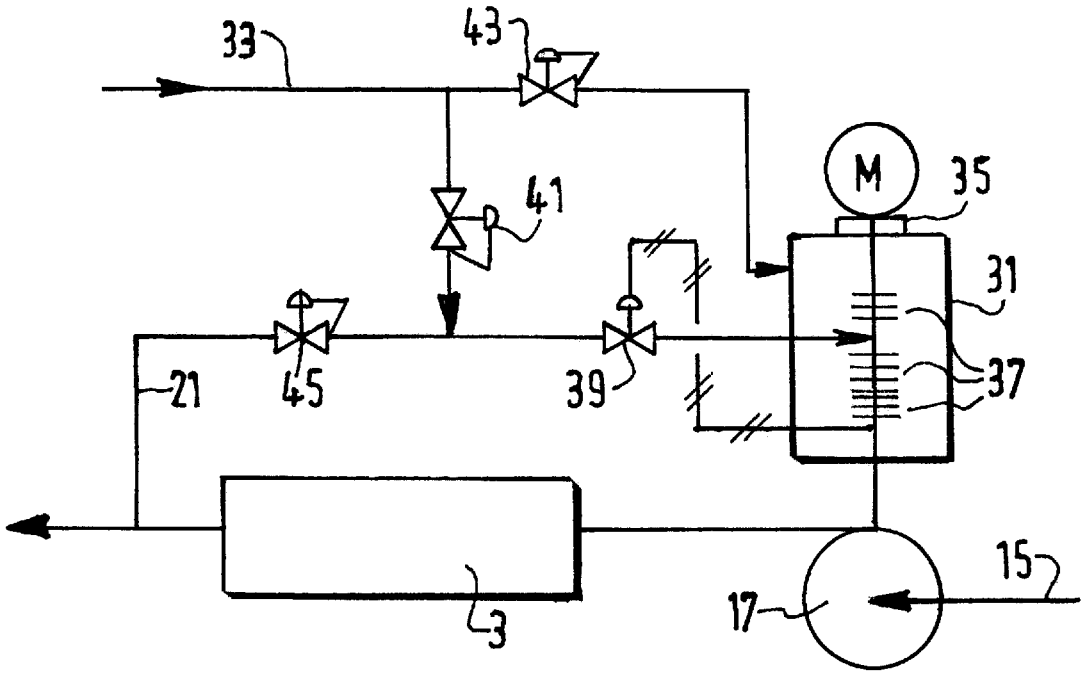
Figure 5:
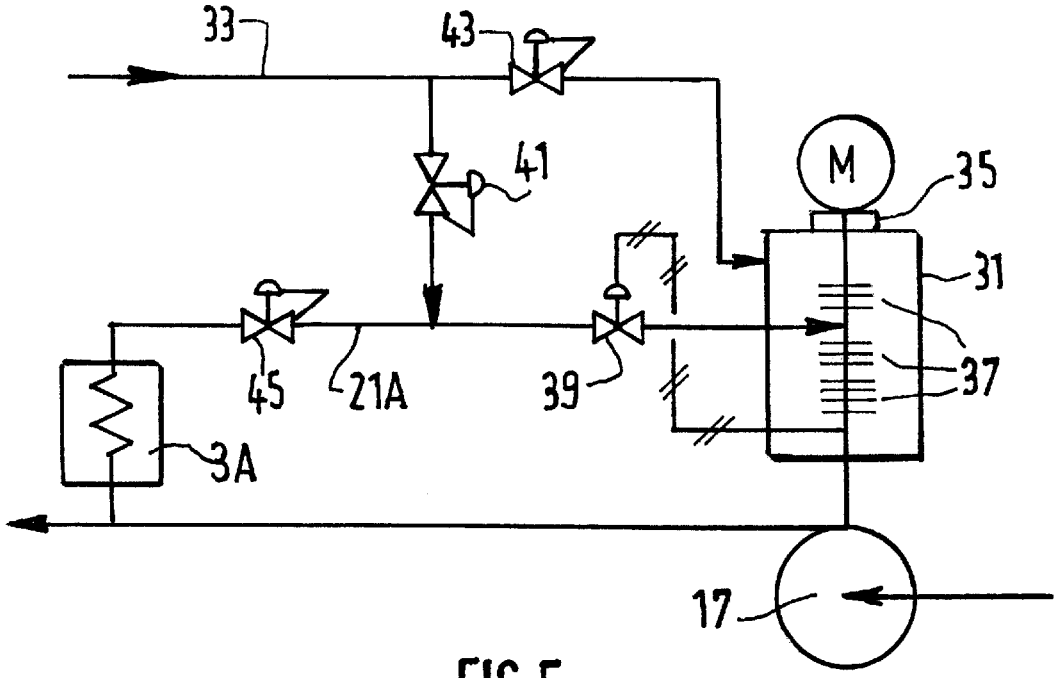

In FIG. 3, an external source of a gas consists of a pipe for oxygen purer than the liquid to be pumped coming from a supply circuit. The pipe is connected to means for sending this pressurized gas to the first pump in order to serve as barrier gas.

What is claimed is:

1. Process for separating a gas mixture by cryogenic distillation, which comprises:

cooling at least one portion of a gas mixture compressed and purified in a heat exchanger so as to obtain a cooled mixture;

sending the cooled mixture to a distillation column of a system comprising at least one column;

withdrawing a liquid from a column of the system to obtain a withdrawn liquid;

pressurizing the withdrawn liquid in a first pump; and using, as barrier gas for one or more pumps of the system, at least one of:

i) a gas coming from at least one external source other than a column of the system;

ii) a vapour produced by vaporizing a liquid coming from an external source; and iii) a vapour produced by vaporizing a portion of a liquid withdrawn from a column of the system and pressurized in the first pump or a second pump.

2. The process according to claim 1, wherein the barrier gas comprises a gas coming from at least one external source other than a column of the system.

3. The process according to claim 1, wherein the barrier gas comprises a vapour produced by vaporizing a liquid coming from an external source.

4. The process according to claim 1, wherein the barrier gas comprises a vapour produced by vaporizing a portion of a liquid withdrawn from a column of the system, and pressurized in the first pump or the second pump.

5. The process according to claim 1, further comprising vaporizing in the heat exchanger a portion of the withdrawn liquid pressurized in the first pump.

6. The process according to claim 5, further comprising heating in the heat exchanger at least one gas produced by the column.

7. The process according to claim 5, wherein only the portion of the gas mixture and the liquid which is pressurized in the first pump are sent to the heat exchanger.

8. The process according to claim 1, wherein the liquid vaporized in order to form the barrier gas is pressurized by a second pump; said liquid having the same main component as the liquid pressurized in the first pump and being as pure as or purer than the liquid pressurized in the first pump.

9. The process according to claim 1, wherein the gas mixture is air and the liquid pressurized in the first pump is rich in oxygen, nitrogen or argon.

10. The process according to claim 1, wherein the gas mixture contains at least 1 mol % methane, at least 1 mol % carbon monoxide, at least 1 mol % hydrogen, and at least 1 mol % nitrogen, and the liquid pressurized in the first pump is rich in methane, carbon monoxide, hydrogen or nitrogen.

11. The process according to claim 1, wherein the barrier gas is at a pressure greater than the pressure in the first pump.

12. The process according to claim 1, further comprising sending the barrier gas to all the pumps of the system which pump a liquid having the same main component as the liquid pumped by the first pump.

13. The process according to claim 1, wherein the system includes a pump for sending a liquid from one of the columns to a storage tank, and a pump for sending liquid from one column of the system to another column of the system.

14. Plant for separating a gas mixture by cryogenic distillation, which comprises:

a heat exchanger;

a first pump and a second pump;

a system of distillation columns, including at least one column;

means for sending at least one portion of the gas mixture to the heat exchanger, and then to a column of the system;

means for withdrawing a liquid from a column of the system; and sending means for sending a barrier gas to one or more pumps; said sending means comprising at least one of:

i) at least one external source of a pressurized gas coming from other than a column of the system, and means for forwarding said pressurized gas to the first pump in order to serve as the barrier gas;

ii) at least one external source of liquid coming from other than a column of the system; and the means for vaporizing at least one portion of said liquid and for forwarding vapour thus formed to the first pump in order to serve as the barrier gas; and iii) means for withdrawing a liquid from a column of the system and for vaporizing at least one portion thereof downstream of the first or of the second pump in order to deliver the barrier gas for the first pump.

15. The plant according to claim 14, further comprising means for sending the liquid from at least one of the first and the second pump to the heat exchanger, and means for withdrawing vaporized liquid from the heat exchanger.

16. The plant according to claim 14, further comprising another heat exchanger for vaporizing the liquid intended to deliver the barrier gas.

17. The plant according to claim 14, wherein the gas mixture is air and the system of columns comprises at least one of a triple column, a double column, and a single column, and combined with an argon column or a mixing column.

18. The plant according to claim 14, wherein the first pump is a labyrinth-seal pump.

19. The plant according to claim 14, wherein the second pump is a labyrinth-seal pump.

20. The plant according to claim 14, further comprising means for sending the barrier gas to all the pumps of the system which pressurize a liquid having the same main component as the liquid pressurized by the first pump.

21. The plant according to claim 14, further comprising a pump for sending liquid from a column of the system to a storage tank, and a pump for sending liquid from a column or a condenser of the system to another column or another condenser of the system.

* * * * *